United States Patent [19]

Ideta

[11] Patent Number: 4,944,618

[45] Date of Patent: Jul. 31, 1990

[54] MULTICOLOR INK RIBBON SWITCHING SYSTEM FOR PRINTER

[75] Inventor: Yorihiko Ideta, Tokyo, Japan

[73] Assignee: NEC Corporation, Tokyo, Japan

[21] Appl. No.: 285,294

[22] Filed: Dec. 15, 1988

Related U.S. Application Data

[63] Continuation of Ser. No. 7,203, Jan. 27, 1987, abandoned.

[30] Foreign Application Priority Data

Jan. 27, 1986 [JP] Japan ..... 61-15284

[51] Int. Cl.[5] ..... B41J 33/14; B41J 35/14

[52] U.S. Cl. ..... 400/211; 400/212; 400/216.1; 400/225; 400/185

[58] Field of Search ..... 400/185, 187, 216.1, 400/227.2, 212

[56] References Cited

U.S. PATENT DOCUMENTS

| | | | |
|---|---|---|---|
| 3,346,090 | 10/1967 | Goff, Jr. et al. | 400/227.2 |
| 3,349,888 | 10/1962 | Page | 400/227.2 |
| 4,115,013 | 9/1978 | Hedstrom | 400/208 |
| 4,329,072 | 5/1982 | Kacmarcik | 400/212 |
| 4,573,813 | 3/1986 | Aoki et al. | 400/216.1 |
| 4,589,788 | 5/1986 | Lendl | 400/212 |
| 4,606,662 | 8/1986 | Komplin | 400/185 |
| 4,611,938 | 9/1986 | Rettke et al. | 400/227.2 |
| 4,636,098 | 1/1987 | Halter et al. | 400/212 |
| 4,741,638 | 5/1988 | Okabayashi et al. | 400/225 |

FOREIGN PATENT DOCUMENTS

| | | | |
|---|---|---|---|
| 33975 | 4/1981 | Japan | 400/227.2 |
| 126183 | 7/1983 | Japan | 400/185 |
| 176085 | 10/1984 | Japan | 400/227.2 |
| 222380 | 12/1984 | Japan | 400/227.2 |
| 205170 | 9/1986 | Japan | 400/182 |

OTHER PUBLICATIONS

Greenlief et al, "Variable Lift . . . Mechanism", IBM Technical Disclosure Bulletin, vol. 26, No. 3B, pp. 1580–1582, 8–83.

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

A multicolor ink ribbon switching system for a printer includes at least one discrimination switch, a controller, a cassette swinging mechanism, and a ribbon feed mechanism. The discrimination switch discriminates whether a ribbon cassette mounted on a base is a multicolor or monochromatic ink ribbon cassette. The controller receives an output from the discrimation switch. If the output represents the multicolor ribbon cassette, the controller outputs a swinging signal in the color switching mode and a ribbon feed signal in the printing mode. However, if the output represents a monochromatic ribbon cassette, the controller outputs a ribbon feed signal. The cassette swinging mechanism causes the ribbon cassette to swing in response to the cassette swinging signal to switch ribbon colors. The ribbon feed mechanism winds the ribbon in response to the ribbon feed signal from the controller.

3 Claims, 6 Drawing Sheets

MULTICOLOR INK RIBBON SWITCHING SYSTEM FOR PRINTER

This is a continuation of application Ser. No. 07/007,203, filed Jan. 27, 1987, file now abandoned.

BACKGROUND OF THE INVENTION

The present invention relates to a multicolor ink ribbon switching system for a printer and, more particularly, to a multicolor ink ribbon switching system capable of using both a multicolor ink ribbon and a monochromatic ink ribbon.

Since a conventional multicolor ribbon switching system does not include a means for discriminating a monochromatic ink ribbon from a multicolor ink ribbon, these two types of ribbons cannot be interchangeably used, resulting in inconvenience.

Further, in the conventional multicolor ribbon switching system, shifting operation for changing the color of the ribbon and an operation for feeding the ribbon are performed by different driving means, and, therefor, two driving sources (motors) are required.

SUMMARY OF THE INVENTION

It is an object of the present invention to eliminate the conventional drawback described above and to provide a multicolor ink ribbon switching system for a printer which allows use of a monochromatic ink ribbon.

It is another object of the present invention is to provide a printer in which the changing operation of the color of the ribbon and the feeding operation of the ribbon can be performed by a single driving source.

According to the present invention, there is provided a multicolor ink ribbon switching system comprising a base including a cassette support for detachably and swingably supporting a ribbon cassette, at least one discrimination switch, mounted on the base, for discriminating the type of ribbon cassette mounted on the base, the discrimination switch being arranged to generate a first signal when a multicolor ribbon cassette is mounted on the base and a second signal when a monochromatic ribbon cassette is mounted thereon, a controller for receiving an output signal from the at least one discrimination switch, for generating a cassette swinging signal at the time of color switching and a ribbon feed signal at the time of printing when the output signal is the first signal, and for generating the feed signal when the output signal is the second signal, a cassette swinging mechanism, controlled in response to an output from the controller, for swinging the multicolor ribbon cassette in response to the swinging signal and changing ribbon colors, and a ribbon feed mechanism, controlled in response to an output from the controller, for winding the ribbon in the ribbon cassette in response to the feed signal.

DETAILED DESCRIPTION OF THE PREFERRED EMBODIMENTS

A preferred embodiment of the present invention will be described in detail with reference to the accompanying drawings.

Figure 1:
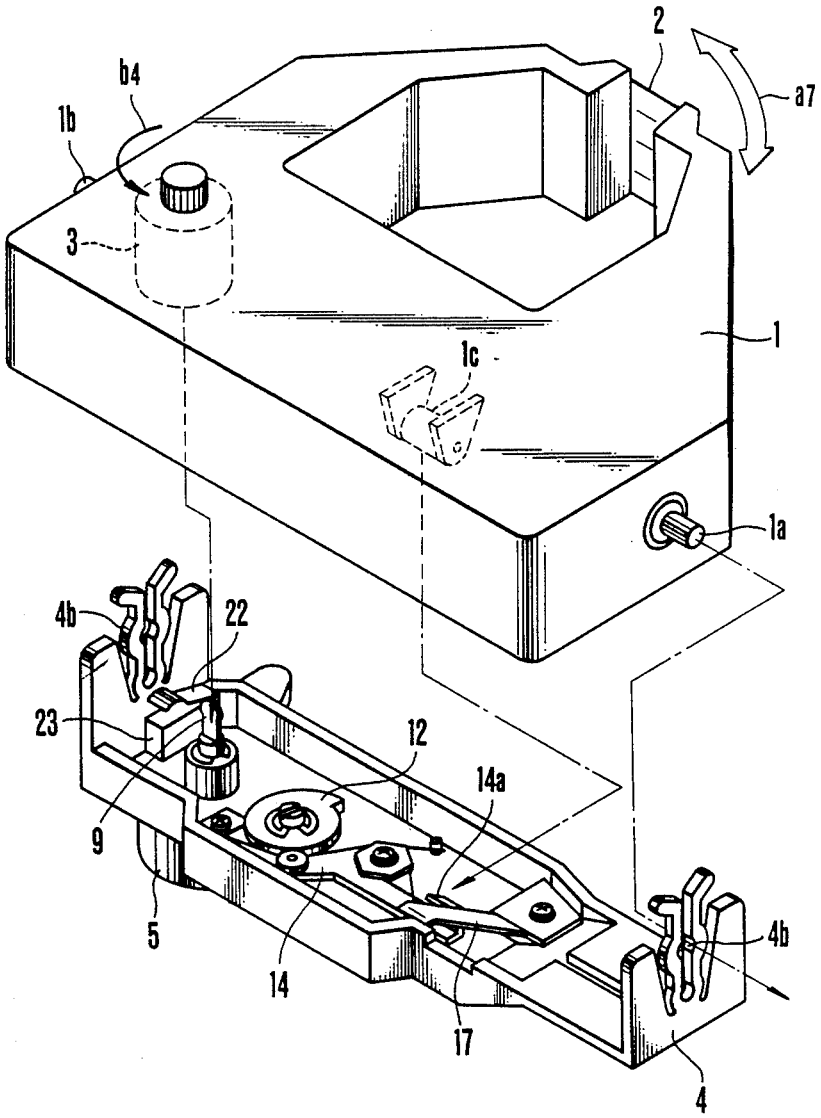
FIG. 1 is a perspective view of a multicolor ink ribbon switching system according to an embodiment of the present invention.

Referring to FIG. 1, an endless, looped multicolor ink ribbon 2 having four colors is accommodated in a multicolor ribbon cassette 1. The multicolor ribbon cassette 1 incorporates rotary pivots 1*a* and 1*b*, a cylindrical ink ribbon switching roller 1*c*, and a ribbon feed roller 3.

Figure 2:
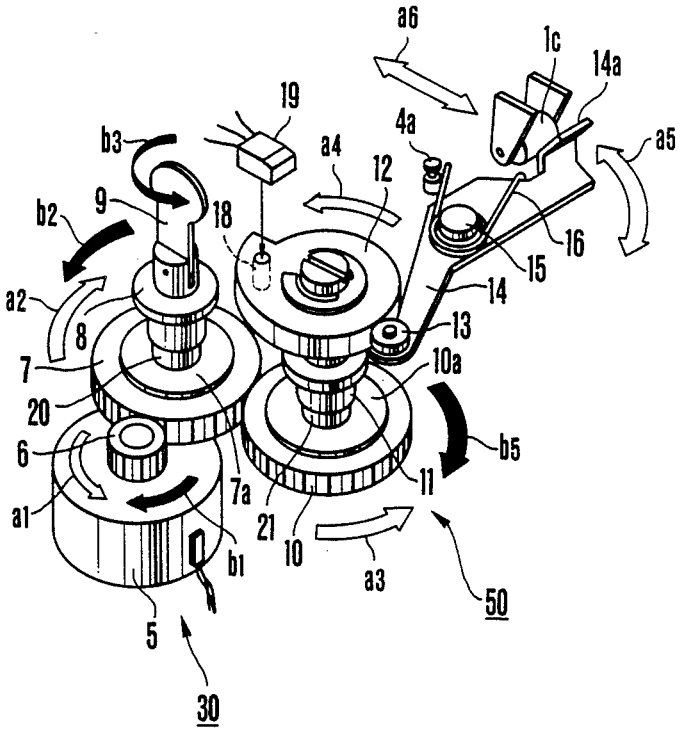
FIG. 2 is a perspective view showing a detailed arrangement of part of the system in FIG. 1.

A ribbon base 4 is fixed on a carrier (not shown) and causes the carrier to rotatably hold the multicolor ribbon cassette 1. Supports 4*b* are formed at both ends of the ribbon base 4 to hold the pivots 1*a* and 1*b*. As is best illustrated in FIG. 2, a stepping motor 5, a feed mechanism 30, and a swinging mechanism 50 are arranged on the ribbon base 4. A motor gear 6 is fixed on a shaft of the stepping motor 5. A feed gear 7 is meshed with the motor gear 6. The feed gear 7 is also meshed with a switching gear 10.

A one-way clutch 7*a* is coupled to the feed gear 7 to transmit a rotational force in one rotational direction shown by arrow b2. One end of a feed shaft 20 is connected to the one-way clutch 7*a*. The feed shaft 20 is rotatably supported by a bearing bush 8. A torque piece 9 is fixed to the other end of the feed shaft 20. The roller 3 in the multicolor ribbon cassette 1 is engaged with the torque piece 9.

A one-way clutch 10*a* is coupled to the switching gear 10 to transmit a rotational force in one rotational direction shown by arrow a3. One end of a change shaft 21 is connected to the one-way clutch 10*a*. The change shaft 21 is rotatably supported by a bearing bush 11. A positioning cam 12 is fixed to the other end of the change shaft 21. A magnet 18 is embedded in the positioning cam 12 to detect a home position. The magnet 18 cooperates with a Hall element 19 opposite thereto to detect the home position. A cam roller 13 rotatably mounted at one end of the change lever 14 with a rotating shaft 15 abuts against the positioning cam 12. An L-shaped abutment piece 14*a* extends from the other end of the change lever 14 and abuts against the switching roller 1*c* arranged in the multicolor ink ribbon cassette 1. It should be noted that the change lever 14 is always biased by a bias spring 16 in a predetermined direction. The switching roller 1*c* can be unrotational.

A tension spring 17 is arranged in the ribbon base 4 to always bias the front end portion of the multicolor ribbon cassette 1 downward.

Figure 3:
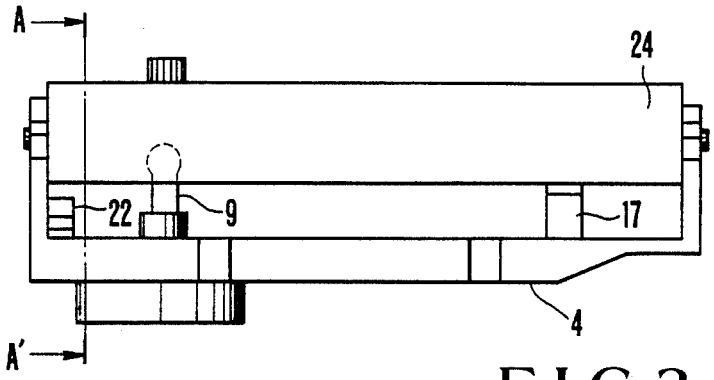
FIG. 3 is a rear view of the multicolor ink ribbon switching system of FIG. 1 when a monochromatic ribbon cassette is mounted therein.
Figure 4:
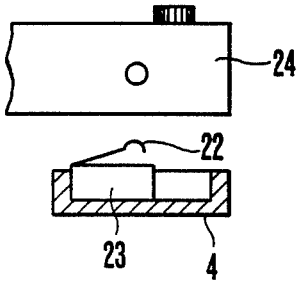
FIG. 4 is a sectional view of the system in FIG. 3 taken along the line A—A' thereof.
Figure 5:
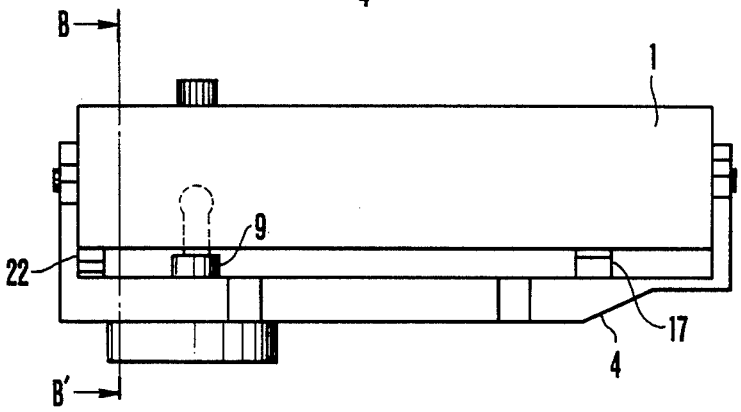
FIG. 5 is a rear view of the multicolor ink ribbon switching system in FIG. 1 when a multicolor ink ribbon cassette is mounted therein.
Figure 6:
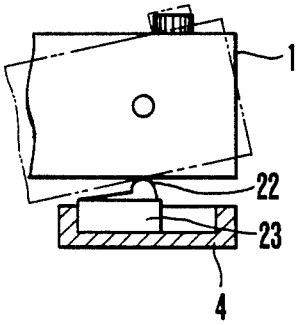
FIG. 6 is a sectional view of the system in FIG. 5 taken along the line B—B' of FIG. 5.

A microswitch 23 as a discrimination switch having an actuator 22 is fixed on the ribbon base 4. The microswitch 23 with the actuator 22 is designed to discriminate a monochromatic ribbon cassette 24 from the multicolor ribbon cassette 1. The monochromatic ribbon cassette 24 has a small width, as shown in FIG. 3, and does not move the actuator 22 of the microswitch 23 downward even if the cassette 24 is mounted on the ribbon base 4. However, the multicolor ribbon cassette 1 has a large width, as shown in FIGS. 5 and 6. When the cassette 1 is mounted on the ribbon base 4, it moves the actuator 22 downward.

Figure 7:
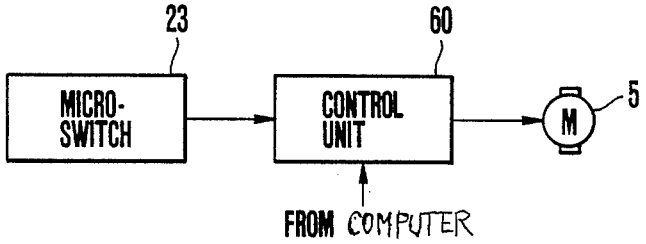
FIG. 7 is a block diagram of an electrical circuit in the multicolor ink ribbon switching system in FIG. 1.

As shown in FIG. 7, the microswitch 23 is electrically connected to a control unit 60. When the actuator 22 is moved downward and its detection signal is sent from the microswitch 23 to the control unit 60, the control unit 60 sends a swinging signal to the stepping motor 5 in the color switching mode and a feed signal to the motor 5 in the printing mode in response to an instruction by a computer. However, when the detection signal representing that the actuator 22 is moved downward is not sent to the control unit 60, the control unit 60 sends the feed signal to the stepping motor 5 in the printing mode in response to the instruction by the computer.

The operation of the control device having the above arrangement will be described below.

When the multicolor ribbon cassette 1 is mounted on the ribbon base 4 and the actuator 22 is moved downward, the microswitch 23 is turned on. In the printing mode, the feed signal is sent from the control unit 60 to the stepping motor 5, and the stepping motor 5 is rotated in a direction indicated by an arrow b1. A rotational force is transmitted to the roller 3 through the motor gear 6, the feed gear 7, the feed shaft 20, and the torque, piece 9. Therefore, the multicolor ink ribbon 2 is fed. At this time, although the switching gear 10 is rotated in a direction indicated by an arrow b5, the change shaft 21 is kept stopped by the behavior of the one-way clutch 10*a*. In the color switching mode, the control unit 60 sends the swinging signal to the stepping motor 5, and the stepping motor 5 is rotated in a direction of an arrow al. A rotational force is transmitted to the positioning cam 12 through the motor gear 6, the feed gear 7, the switching gear 10, and the change shaft 21. In this case, the positioning cam 12 is rotated in a direction indicated by an arrow a4. The change lever 14 is shifted by a distance represented by the swinging signal in a direction indicated by an arrow a5. Therefore, the front end of the multicolor ribbon cassette 1 is swung in a direction indicated by an arrow a7, thereby selecting a necessary position. In this case, the feed shaft 20 is kept stopped by the one-way clutch 7*a* incorporated in the feed gear 7.

Figures 11A, 11B, 11C, 11D:
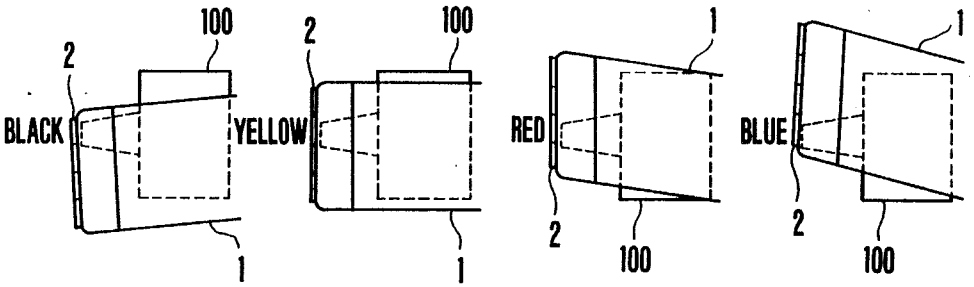
FIG. 11A to 11D are side views of the ribbon cassette for explaining the color changing operation.
Figure 12:
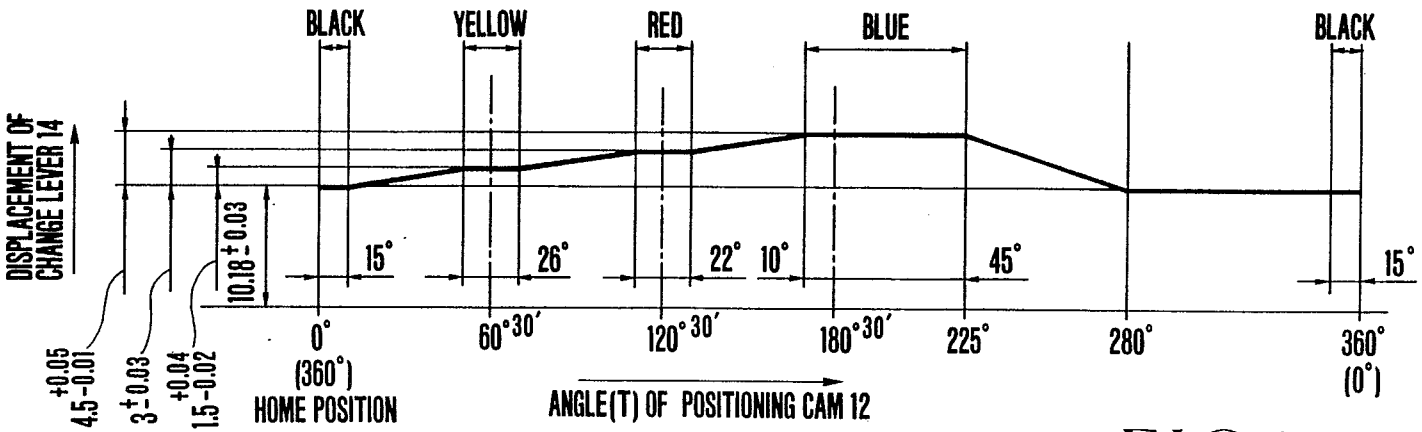
FIG. 12 is a graph for explaining the color changing operation.

The relationship between positions of the four color (i.e., black, yellow, red, and blue) ribbons of the multicolor ribbon cassette 1, the angles of the positioning cam 12, and the displacements of the change lever 14 will be described with reference to FIGS. 11A to 11D and FIG. 12. FIGS. 11A to 11D are side views showing the positional relationships between the multicolor ribbon cassette 1 and the ink ribbon 2 in four color print modes, respectively. FIG. 12 is a graph showing the relationship between the angle of the positioning cam 12 and the displacement of the change lever 14 at the time of each color printing. Reference numeral 100 denotes a printing head.

The home position (0°) of the positioning cam 12 driven by the stepping motor 5 is detected by the magnet 18 and the Hall element 19. If the positioning cam 12 is located at an angular position falling within the ranges of 345° to 360° and 0° to 15° along the a4 direction, the multicolor ribbon cassette 1 is located at the position where the black ribbon portion is subjected to printing (FIG. 11A). When the positioning cam 12 is located at an angular position falling within the range of 47° to 73° along the a4 direction, the multicolor ribbon cassette 1 is located at a position where the yellow ribbon portion is subjected to printing (FIG. 11B). When the positioning cam 12 is located at an angular position falling within the range of 109° to 131° along the a4 direction, the multicolor ribbon cassette 1 is located at a position where the red ribbon portion is subjected to printing (FIG. 11C). Finally, when the positioning cam 12 is located at an angular position falling within the range of 170° to 225°, the multicolor ribbon cassette 1 is located at a position where the blue ribbon portion is subjected to printing (FIG. 11D).

When the monochromatic ribbon cassette 24 is mounted on the ribbon base 4, the actuator 22 of the microswitch 23 is not moved downward, and only feeding is performed. In this case, the control unit 60 sends only the feed signal to the stepping motor 5, and the stepping motor 5 is rotated in only the direction indicated by the arrow b1. A rotational force is transmitted to the roller 3 through the motor gear 6, the feed gear 7, the feed shaft 20, and the torque piece 9. In this case, the switching gear 10 is rotated in only the direction indicated by the arrow b5, but the change shaft 21 is kept stopped by the behavior of the one-way clutch 10*a*.

Since a common drive source is used for ribbon switching and ribbon feeding and the rotational directions are controlled by the single stepping motor 5, the monochromatic ink ribbon can be used together with the multicolor ink ribbon at low cost with a simple structure.

Figure 9:
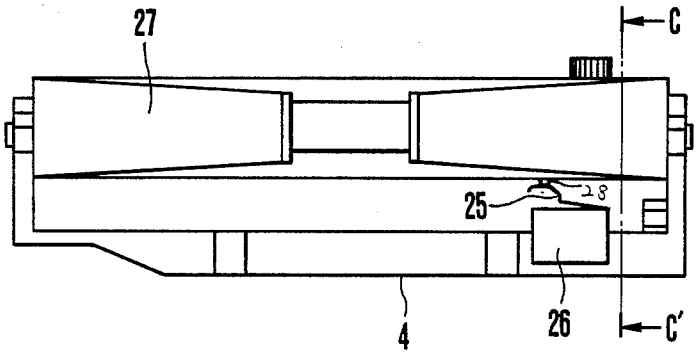
FIG. 9 is a rear view of the multicolor ink ribbon switching system in FIG. 8 when a multistrike ribbon is mounted therein.
Figure 10:
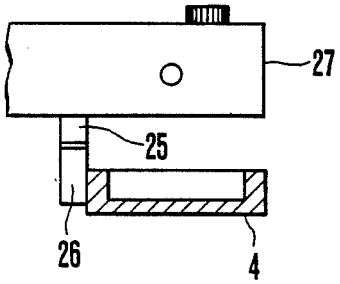
FIG. 10 is a sectional view of the system in FIG. 9 taken along the line C—C' thereof.
Figure 8:
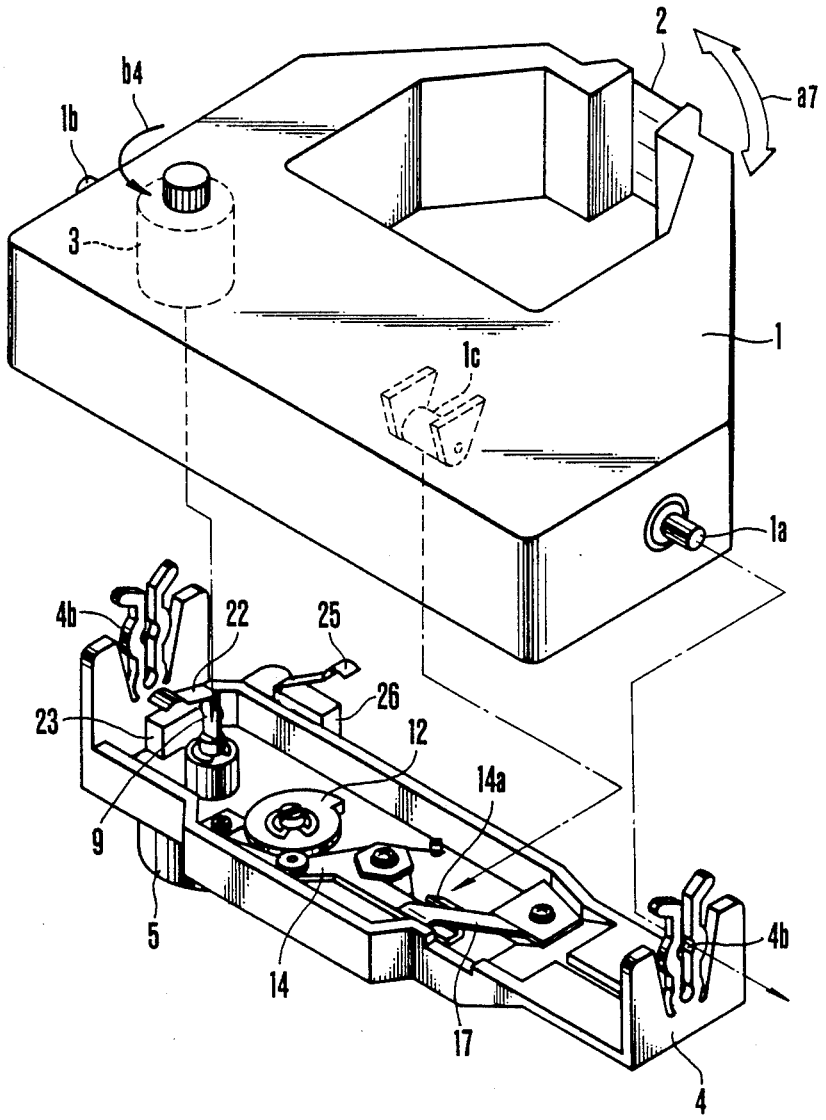
FIG. 8 is a perspective view of a multicolor ink ribbon switching system according to another embodiment of the present invention.

FIGS. 8 to 10 show another embodiment of the present invention. The same reference numerals as in the first embodiment denote the same parts in the second embodiment, and only differences between the first and second embodiments will be described.

Referring to FIG. 8, a microswitch 26 having an actuator 25 serves as a discrimination switch and is mounted at the side surface of a ribbon base 4. The microswitch 26 with the actuator 25 is designed to identify a multistrike ribbon cassette 27 by a projection 28 formed on the bottom surface of the multistrike ribbon cassette 27. Other arrangements of the second embodiment are the same as those of the first embodiment.

The operation of the embodiment in FIG. 8 will be described below. Assume that an actuator 22 of a microswitch 23 is not moved downward but that the actuator 25 is moved downward. In this case, a control unit 60 sends a multistrike ribbon command to a stepping motor 5 to increase the feed speed. The stepping motor 5 is rotated in only a direction indicated by an arrow b1. A rotational force is transmitted to a ribbon running roller 3 through a motor gear 6, a feed gear 7, a feed shaft 20, and a torque piece 9. In this case, a switching gear 10 is rotated in only a direction indicated by an arrow b5, and a change shaft 21 is kept stopped by the behavior of the one-way clutch.

According to the present invention, since a multicolor ink ribbon switching mechanism for a printer has a structure including a swinging mechanism for causing the multicolor ribbon cassette to swing to switch ribbon colors in the color switching mode and a feed mechanism for winding the ribbon in the printing mode, the monochromatic ink ribbon can be interchangeably and easily used with the multicolor ink ribbon.

What is claimed is:

1. A multicolor ink ribbon switching system comprising:

a ribbon cassette swingably supported in a base;

a cassette swinging mechanism for swinging the multicolor ribbon cassette and changing colors of a ribbon; and a ribbon feed mechanism for winding the ribbon in said ribbon cassette;

said cassette swinging mechanism and said ribbon feed mechanism having a common single driving source movable in a first rotational direction and a second rotational direction opposite to the first rotational direction;

said cassette swinging mechanism comprising:

a first one-way clutch for transmitting a rotational force in said first rotational direction of said single driving source and a first converting mechanism for converting movement of said first one-way clutch into rotation of said cassette, said first converting mechanism comprising:

a switching roller disposed on a bottom surface of said cassette opposite to said base and rotatably mounted in said ribbon cassette, a disc-shaped cam disposed substantially parallel to said base and coaxially coupled to said first one-way clutch, said cam having a center of rotation and a circumferential surface as well as a shape for providing different distances from said center of rotation to various portions of said circumferential surface in accordance with various rotational angles, and a lever means, said lever means comprising a lever, a roller contacting with said circumferential surface of said cam at one end thereof, a fixed shaft disposed at the center of said lever and operative to rotate said lever on a plane substantially parallel to said base, and an L-shaped abutment piece engageable with said switching roller for moving said roller by urging it and thereby converting the rotational movement of said lever into shaft movement of said ribbon cassette in a direction substantially perpendicular to said base, and said ribbon feed mechanism comprising:

a second one-way clutch for transmitting the rotational force in said second rotational direction of said single driving source and a second converting mechanism for converting movement of said second one-way clutch into a winding motion of the ribbon in said ribbon cassette, said second converting mechanism comprising a ribbon running roller rotatably mounted in said ribbon cassette, and a torque piece having one end connected to said second one-way clutch and the other end coupled to a shaft of said ribbon running roller.

2. A system according to claim 1, wherein said single driving source comprises a reversible motor rotated in opposite directions in response to different control signals.

3. A multicolor ink ribbon switching system comprising:

a multicolor ribbon cassette swingably supported in a base;

a single stepping motor, having a shaft, which is arranged on said base and rotates reversibly;

a gear fixed at an end of said shaft of said stepping motor;

a ribbon feed mechanism, arranged on said base, comprising a first disc-shaped gear with said gear of said stepping motor to rotate reversibly and freely in accordance with a rotation of said stepping motor, a first disc-shaped one-way clutch which is engaged with said first disc-shaped gear so as to transfer only a rotational force in one rotational direction of said stepping motor, and a first converting means for converting movement of said first disc-shaped one-way clutch into a winding motion of the ribbon in said multicolor ribbon cassette; and a cassette swinging mechanism, arranged on said base, comprising a second disc-shaped gear meshed with said first disc-shaped gear to rotate reversibly and freely in accordance with the rotation of said stepping motor and second disc-shaped one-way clutch operative so as to transfer only a rotational force in a rotational direction opposite to the one rotational direction of said stepping motor, and a second converting means for converting movement of said second disc-shaped one-way clutch into a swinging motion of said multicolor ribbon cassette, wherein said second converting means comprises:

a switching roller disposed on a bottom surface of said cassette opposite to said base rotatably mounted in said ribbon cassette, a disc-shaped cam disposed substantially parallel to said base and coaxially coupled to said second disc-shaped one-way clutch, said cam having a center of rotation and a circumferential surface as well as a shape for providing different distances from said center of rotation to various portions of said circumferential surface in accordance with various rotational angles, and a lever means, said lever means comprising a lever, a roller contacting with said circumferential surface of said cam at one end thereof, a fixed shaft disposed at the center of said lever and operative to rotate said lever on a plane substantially parallel to said base, and an L-shaped abutment piece engageable with said switching roller for moving said roller by urging it and thereby converting the rotational movement of said lever into shift movement of said ribbon cassette in a direction substantially perpendicular to said base.

* * * * *